US010267019B2

(12) United States Patent
O'Neill et al.

(10) Patent No.: US 10,267,019 B2
(45) Date of Patent: Apr. 23, 2019

(54) DIVIDED PUMP IMPLEMENT VALVE AND SYSTEM

(71) Applicant: Caterpillar Inc., Peoria, IL (US)

(72) Inventors: William Norbert O'Neill, Eureka, IL (US); Michael Thomas Jackson, Hanna City, IL (US)

(73) Assignee: Caterpillar Inc., Deerfield, IL (US)

( * ) Notice: Subject to any disclaimer, the term of this patent is extended or adjusted under 35 U.S.C. 154(b) by 445 days.

(21) Appl. No.: 14/947,840

(22) Filed: Nov. 20, 2015

(65) Prior Publication Data

US 2017/0145660 A1 May 25, 2017

(51) Int. Cl.
*F15B 11/16* (2006.01)
*E02F 9/22* (2006.01)
(Continued)

(52) U.S. Cl.
CPC ..... *E02F 9/2228* (2013.01); *E02F 3/422* (2013.01); *E02F 3/7618* (2013.01); *E02F 9/2235* (2013.01); *E02F 9/2242* (2013.01); *E02F 9/2292* (2013.01); *E02F 9/2296* (2013.01); *F15B 11/17* (2013.01); *F15B 13/022* (2013.01); *F15B 13/06* (2013.01); *E02F 3/34* (2013.01); *F15B 11/165* (2013.01); *F15B 2211/20546* (2013.01); *F15B 2211/20576* (2013.01); *F15B 2211/253* (2013.01); *F15B 2211/4053* (2013.01); *F15B 2211/41518* (2013.01); *F15B 2211/6054* (2013.01); *F15B 2211/6057* (2013.01); *F15B 2211/651* (2013.01);
(Continued)

(58) Field of Classification Search
CPC ..... F15B 11/165
See application file for complete search history.

(56) References Cited

U.S. PATENT DOCUMENTS 4,473,090 A 9/1984 Uehara et al.
4,495,766 A * 1/1985 Krusche ..... F04B 49/08 60/428
(Continued)

FOREIGN PATENT DOCUMENTS

EP 1676963 A2 7/2006
EP 2489883 A1 8/2012
(Continued)

*Primary Examiner* — F. Daniel Lopez
(74) *Attorney, Agent, or Firm* — Miller, Matthias & Hull

(57) ABSTRACT

A hydraulic system and method of controlling such on a machine is disclosed. The hydraulic system may comprise a primary hydraulic circuit that includes a first load sense controlled pump, a secondary hydraulic circuit that includes a second load sense controlled pump, a flow sharing valve, and a load sense arrangement. The load sense arrangement may include a main resolver configured to select a higher pressure signal between the primary and secondary hydraulic circuits, and a load sense valve having an open position at which pressure signal flow between the primary hydraulic circuit and the main resolver is allowed, and a closed position at which pressure signal flow between the primary hydraulic circuit and the main resolver is blocked. In an embodiment, when the load sense valve is in the closed position, the second load sense controlled pump may be controlled only by the secondary hydraulic circuit.

12 Claims, 9 Drawing Sheets

(51) Int. Cl.

| | |
|---|---|
| ***E02F 3/42*** | (2006.01) |
| ***F15B 11/17*** | (2006.01) |
| ***F15B 13/02*** | (2006.01) |
| ***F15B 13/06*** | (2006.01) |
| ***E02F 3/76*** | (2006.01) |
| *E02F 3/34* | (2006.01) |

(52) U.S. Cl.
CPC ..... *F15B 2211/6652* (2013.01); *F15B 2211/7142* (2013.01)

(56) References Cited

U.S. PATENT DOCUMENTS

| | | | | |
|---|---|---|---|---|
| 4,712,376 | A | 12/1987 | Hadank | |
| 5,063,739 | A * | 11/1991 | Bianchetta | F15B 11/17 60/421 |
| 5,471,837 | A * | 12/1995 | Bianchetta | E02F 9/2239 60/426 |
| 5,918,558 | A | 7/1999 | Susag | |
| 5,996,701 | A | 12/1999 | Fukasawa et al. | |
| 7,500,360 | B2 * | 3/2009 | Udagawa | E02F 9/2228 60/421 |
| 8,756,930 | B2 | 6/2014 | Johnson et al. | |
| 9,051,712 | B2 | 6/2015 | Kodaka et al. | |
| 2006/0277905 | A1 * | 12/2006 | Matsumoto | B66F 9/22 60/428 |

FOREIGN PATENT DOCUMENTS

| | | | |
|---|---|---|---|
| EP | 2543776 | A1 | 1/2013 |
| JP | 2013181287 | A | 9/2013 |

* cited by examiner

DIVIDED PUMP IMPLEMENT VALVE AND SYSTEM

TECHNICAL FIELD

The present disclosure relates to a hydraulic system and, more particularly, to a hydraulic system on a machine having a plurality of load sense controlled pumps.

BACKGROUND

Load sense implement systems may have two or more pumps operating in parallel supplying hydraulic fluid to multiple implement functions. Typically, there may be a single load sense signal shared by these pumps. However, during portions of the operating cycle, one implement function may be operating at a high flow and low pressure while another may be operating at high pressure with high or low flow. In this scenario, the pumps deliver flow at a sufficient pressure to meet the demands of the highest pressure function. This may result in the provision of high pressure flow to a high flow but low pressure function. Separation of the pump circuits may not be desirable because, in some scenarios, flow from both pumps may be combined to meet performance requirements.

U.S. Pat. No. 4,473,090 discloses a hydraulic power system for driving implement actuators at constant speed irrespective of loads thereon or engine speed. The hydraulic power system includes a plurality of sources of hydraulic fluid under pressure for powering at least two implement control valve means. One of the pressurized fluid sources communicates with one of the implement control valve means via a restriction. In response to the pressure differential created across the restriction, a first demand valve maintains constant fluid flow to such implement control valve means by controlling communication thereof with the rest of the pressurized fluid sources. Also included is a second demand valve which maintains constant fluid flow to the other implement control valve means in response to a pressure differential across another restriction formed in a conduit communicating the first demand valve and a carry-over port of the one implement control valve means with the other implement control valve means. While beneficial, a better system is needed.

SUMMARY OF THE DISCLOSURE

In accordance with one aspect of the disclosure, a hydraulic system on a machine is disclosed. The machine may include a first implement. The hydraulic system may comprise a primary hydraulic circuit that includes a first load sense controlled pump, a secondary hydraulic circuit that includes a second load sense controlled pump, a flow sharing valve disposed between the primary and secondary hydraulic circuits, and a load sense arrangement for the second load sense controlled pump. The load sense arrangement may include a main resolver configured to select a higher pressure signal between the primary and secondary hydraulic circuits, and a load sense valve having an open position at which pressure signal flow between the primary hydraulic circuit and the main resolver is allowed, and a closed position at which pressure signal flow between the primary hydraulic circuit and the main resolver is blocked. In an embodiment, when the load sense valve is in the closed position, the second load sense controlled pump may be controlled only by the secondary hydraulic circuit.

In accordance with another aspect of the disclosure, a method of controlling a hydraulic system of a machine is disclosed. The machine may include a first implement. The hydraulic system may comprise a primary hydraulic circuit, a secondary hydraulic circuit, a flow sharing valve and a load sense arrangement. The primary hydraulic circuit may include a first load sense controlled pump. The secondary hydraulic circuit may include a second load sense controlled pump. The load sense arrangement may include a main resolver configured to select a higher pressure signal between the primary and secondary hydraulic circuits, and a load sense valve having an open position at which pressure signal flow between the primary hydraulic circuit and the main resolver is allowed, and a closed position at which pressure signal flow between the primary hydraulic circuit and the main resolver is blocked. The method may comprise moving the load sense valve to the closed position and controlling, by only the secondary hydraulic circuit, the second load sense controlled pump when the load sense valve is in the closed position.

In accordance with a further aspect of the disclosure, a hydraulic system on a machine is disclosed. The machine may comprise a first implement and a second implement. The machine may be operable in a work cycle that includes a lift and dump operation of the first implement. The hydraulic system may comprise a primary hydraulic circuit that includes a first load sense controlled pump, first and second lift hydraulic cylinders operably connected to the first implement; a secondary hydraulic circuit that includes a second load sense controlled pump and first and second tilt hydraulic cylinders operably connected to the first implement; a flow sharing valve disposed between the primary and secondary hydraulic circuits; and a load sense arrangement for the second load sense controlled pump. The load sense arrangement may include a main resolver and a load sense valve. The main resolver may be configured to select a higher pressure signal between the primary and secondary hydraulic circuits. The load sense valve may have an open position at which pressure signal flow between the primary hydraulic circuit and the main resolver is allowed, and a closed position at which pressure signal flow between the primary hydraulic circuit and the main resolver is blocked. In an embodiment, when the machine is in the lift and dump operation of the first implement, the load sense valve may be in the closed position and the second load sense controlled pump may be controlled only by the secondary hydraulic circuit.

DETAILED DESCRIPTION

Figure 1:
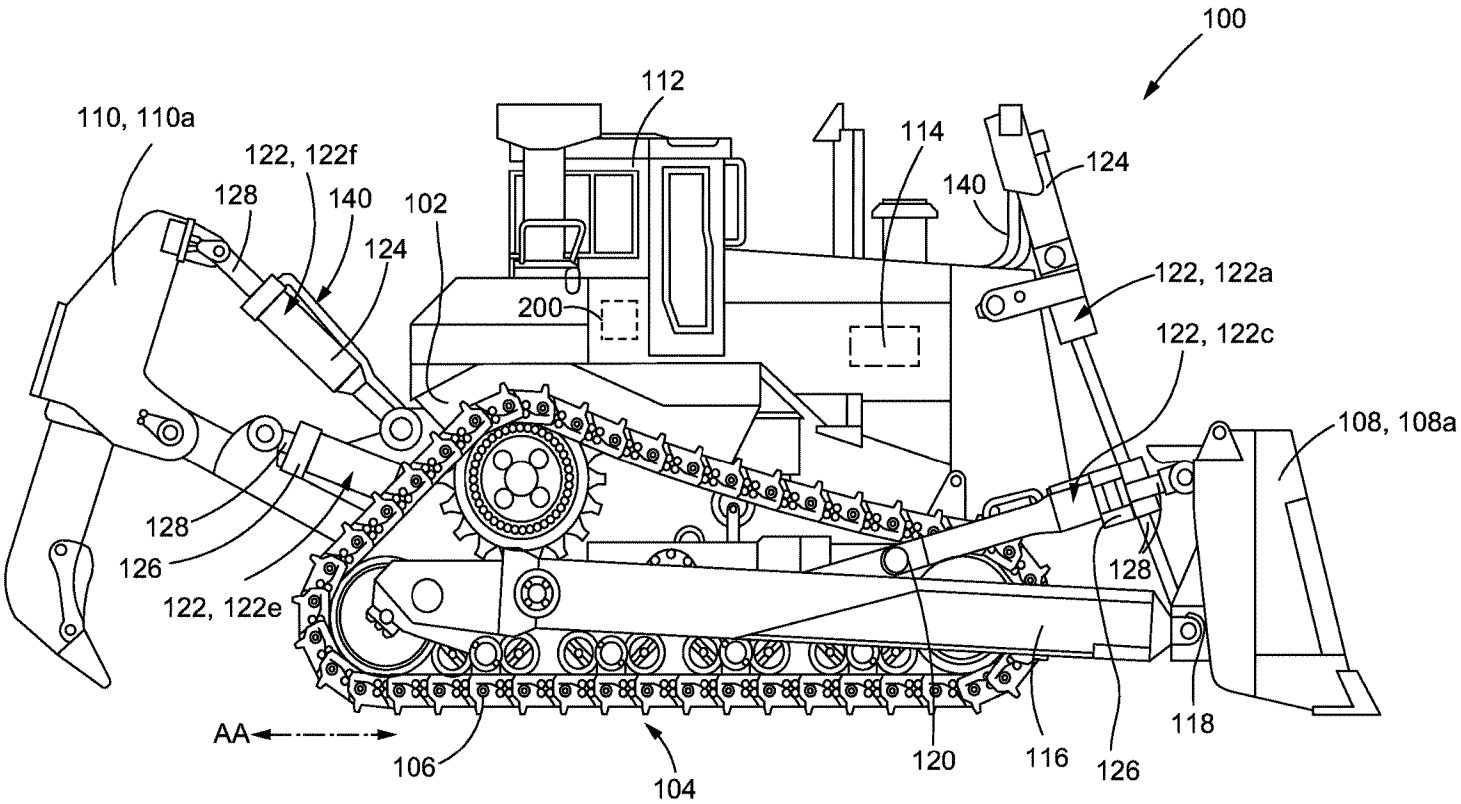
FIG. 1 is a side view of an exemplary machine that includes an implement, according to an exemplary embodiment of the current disclosure.

FIG. 1 illustrates an exemplary disclosed machine 100. For example, the exemplary machine 100 may be a track-type tractor such as a dozer. While this disclosure is provided with primary reference to the exemplary dozer, it will be understood that the teachings of this disclosure may be employed with equal efficacy in conjunction with other machines, such as loaders, excavators, pipelayers, or the like. Still further, the machine 100 may have any type of track, wheel or other ground engaging member used for transportation.

The machine 100 includes a frame 102 defining a longitudinal axis AA and a transverse axis BB (shown in FIG. 2) that is substantially perpendicular to the longitudinal axis AA. In the illustrated embodiment shown in FIG. 1, the machine 100 includes an undercarriage 104 supported on the frame 102 of the machine 100. The undercarriage 104 includes the set of ground engaging members 106 embodied as a track assembly. The track assembly may be configured to rotate thereby propelling the machine 100. Alternatively, the set of ground engaging members 106 may be a plurality of wheels supported on the frame 102 and configured to propel the machine 100.

The machine 100 further includes a first implement 108 configured to perform various tasks at a worksite. The first implement 108 may be configured to engage, penetrate, or cut the surface of the worksite and/or may be further configured to move the earth to accomplish a predetermined task. The worksite may include, for example, a mine site, a landfill, a quarry, a construction site, or any other type of worksite. Moving the earth may be associated with altering the geography at the worksite and may include, for example, a grading operation, a scraping operation, a leveling operation, a bulk material removal operation, or any other type of geography altering operation at the worksite.

In the illustrated embodiment, the first implement 108 is a blade 108*a* that may be movably mounted to the frame 102. The first implement 108 may be disposed on the frame 102 at a front end of the machine 100. The first implement 108 may be configured to perform a digging operation to dig material from the work site and also to hold the material therein. While holding the material, the first implement 108 may be moved along the longitudinal axis AA to reach a location for dumping the material. The first implement 108 may also be raised to reach the location for dumping the material. Further, the first implement 108 may also be configured to rotate about the transverse axis BB upon reaching the location thereby dumping the material.

In one embodiment, a lift and dump operation for the first implement 108 may be defined as a work cycle in which the first implement 108 holds the material and then lifts and dumps the held material. Accordingly, in one embodiment of the lift and dump operation, the first implement 108 may be moved along the longitudinal axis AA and raised to reach the dumping location and subsequently rotated about the transverse axis BB. In another example of the lift and dump operation, the first implement 108 may be raised and simultaneously rotated about the transverse axis BB to perform the dumping operation.

The machine 100 may further include a second implement 110 mounted on the frame 102. For example, the second implement 110 may include a blade, a bucket, a shovel, a hammer, an auger, a ripper, or any other task-performing device known in the art. In the exemplary machine 100, the exemplary second implement 110 is a ripper 110*a*.

The machine 100 may further include an operator station or cab 112 containing controls or input devices for operating the machine 100. The cab 112 may also include one or more input devices (not shown) for propelling the machine 100, controlling the first and second implements 108, 110 and/or other machine components. In an example, the one or more input devices may include one or more joysticks, levers, switches and pedals disposed within the cab 112 and may be adapted to receive input from an operator indicative of a desired movement of the first and second implements 108, 110 and the set of ground engaging members 106.

The machine 100 may further include a power source 114 to supply power to various components including, but not limited to, the set of ground engaging members 106, and the first and second implements 108, 110. In an example, the power source 114 may be an engine. The engine may embody, for example, a diesel engine, a gasoline engine, a gaseous fuel-powered engine, or any other type of combustion engine known in the art. It is contemplated that the power source 114 may alternatively embody a non-combustion source of power such as, for example, a fuel cell, a power storage device, or another suitable source of power.

Figure 2:
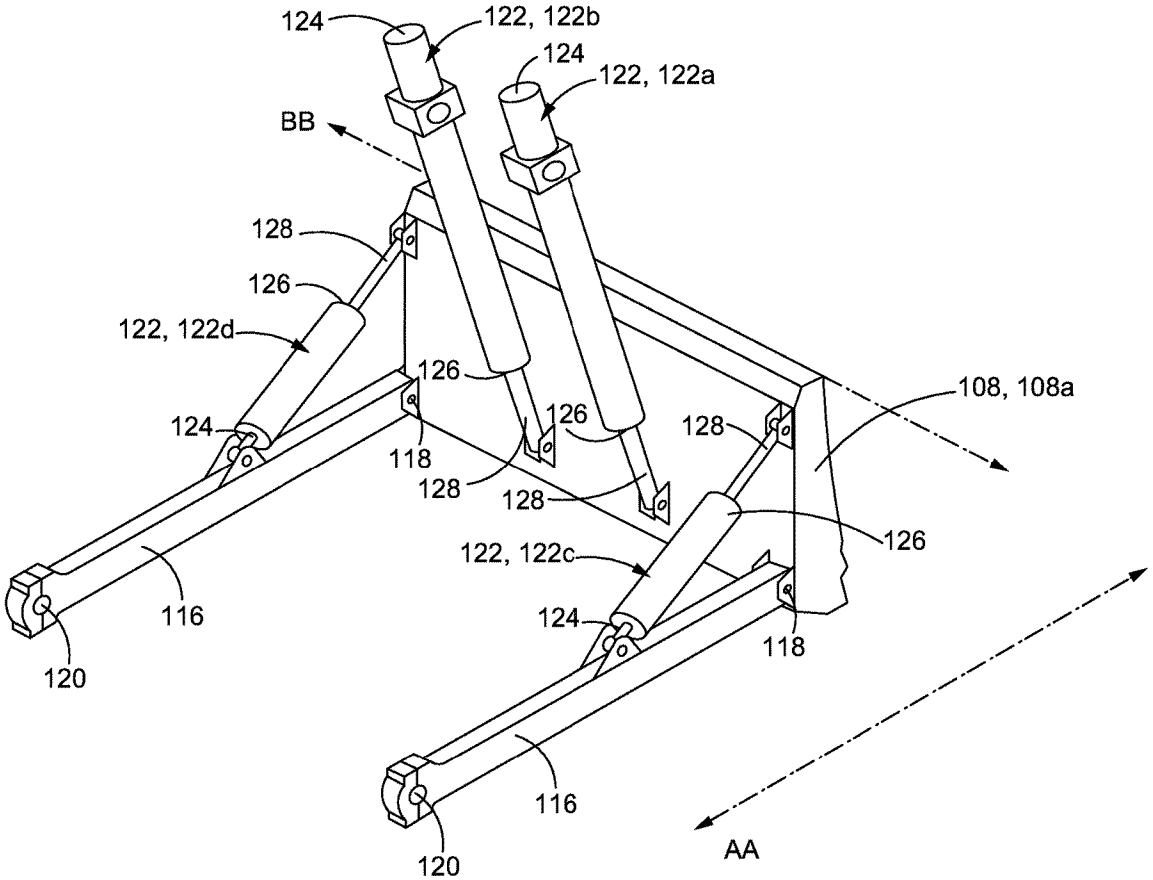
FIG. 2 is a partial perspective view of one of the implements and hydraulic cylinders for actuating such implement.

Referring to FIGS. 1 and 2, the machine 100 may include a pair of push arms 116 spaced apart from each other. The first end 118 of each of the push arms 116 may be pivotally coupled to the first implement 108. As shown in FIG. 1, the second end 120 of each of the push arms 116 may be pivotally coupled to the undercarriage 104. Alternatively, the second end 120 of each push arm 116 may be coupled to the frame 102. The push arms 116 may be connected to the first implement 108 and the frame 102 in a conventional manner, such as by a pivot shaft that pivotally connects the first implement 108 to the frame 102. The push arms 116 may have a substantially same length and may be configured to hold the first implement 108 at the front end of the machine 100. Further, the push arms 116 may be configured to move the first implement 108 along the longitudinal axis AA.

The machine 100 may include hydraulic actuators, such as hydraulic cylinders 122, configured to lift or otherwise move the first and second implements 108, 110. In one embodiment, the machine 100 may include first and second lift hydraulic cylinders 122*a*, 122*b* (FIG. 2), and first and second tilt hydraulic cylinders 122*c*, 122*d*, each configured to move the first implement 108 (in the exemplary embodiment, a blade 108*a*). In the exemplary embodiment, the machine 100 may further include an auxiliary lift hydraulic cylinder 122*e* (FIG. 1) and an auxiliary tilt hydraulic cylinder 122*f*, each configured to move the second implement 110 (in the exemplary embodiment, a ripper 110*a*).

Figure 3:
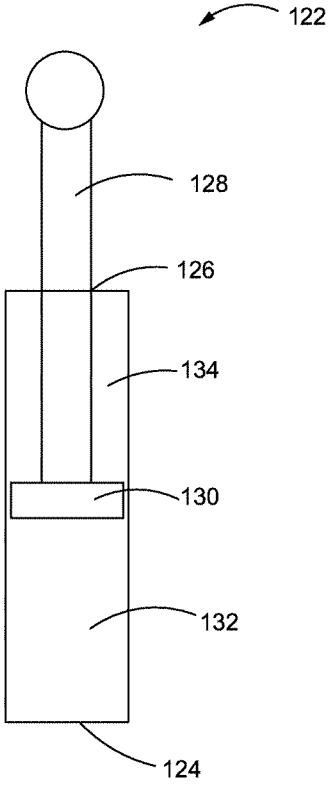
FIG. 3 is a cut away view of an exemplary hydraulic cylinder.

In an embodiment, each of the hydraulic cylinders 122 (*a-f*) may be a double acting hydraulic cylinder 122 that includes a cap end 124, a rod end 126, and a rod 128 as shown in FIG. 3. The rod 128 is slidably received in the hydraulic cylinder 122. The rod 128 may include a piston 130 operable to divide the inside of the hydraulic cylinder 122 into two chambers, namely, the cap end chamber 132 and the rod end chamber 134. In the illustrated embodiment, the hydraulic cylinders 122 may be oriented such that an extending movement of the rods 128 increases the volume of the cap end chambers 132.

In the embodiment shown in FIGS. 1-2, the first, second and auxiliary lift hydraulic cylinders 122(*a,b,e*) may be coupled to the frame 102 proximal to the cap end 124 and may be operatively coupled to their respective implement(s) 108,110 via the rods 128. In another embodiment, the rods 128 of the first and second lift hydraulic cylinders 122*a*, 122*b* may, instead, be operatively coupled to the corresponding push arms 116 of the machine 100. Alternatively, in yet another embodiment, one or more of the first, second or auxiliary lift hydraulic cylinders 122(*a,b,e*) may be coupled to the frame 102 by the rods 128 and may be coupled to its respective implement 108/110 (or the push arms 116) proximal to the cap end 124.

The first, second and auxiliary lift hydraulic cylinders 122(*a,b,e*) are configured to raise or lower their respective implement 108/110 with respect to the frame 102 of the machine 100. In one embodiment, a retracting movement of the rod 128 of one or more of the first, second or auxiliary lift hydraulic cylinders 122(*a,b,e*) may raise its respective implement 108/110 and an extending movement of the rod 128 may lower its respective implement 108/110.

For example, pressurized (hydraulic) fluid may flow into the cap end chamber 132 (FIG. 3) and extend the rod 128 from the first, second or auxiliary lift hydraulic cylinder 122(*a,b,e*) (FIGS. 1-2), thereby lowering its associated implement 108/110. As the pressurized fluid flows into the cap end chamber 132 (FIG. 3) from the fluid source, the fluid flows out of the rod end chamber 134. The pressurized fluid may also flow into the rod end chamber 134 (FIG. 3) and retract the rod 128 into the first, second or auxiliary lift hydraulic cylinder 122(*a,b,e*), and thereby raise the associated implement 108/110. As the pressurized fluid flows into the rod end chamber 134, fluid flows out of the cap end chamber 132.

In an embodiment, each of the first, second or auxiliary tilt hydraulic cylinders 122(*c-d, f*) (FIGS. 1-2) may be pivotally coupled to its respective implement 108/110 proximal to the rod end 126. First and second tilt hydraulic cylinders 122 (*c-d*), may be pivotally coupled to the corresponding push arms 116 of the machine 100 proximal to the cap end 124. First auxiliary tilt hydraulic cylinder 122*f* may be coupled to the frame 102 of the machine 100 proximal to the cap end 124. Alternatively, each of the first, second or auxiliary tilt hydraulic cylinders 122(*c-d, f*) may be pivotally coupled to its respective implement 108/110 proximal to the cap end 124, and the first and second tilt hydraulic cylinders 122(*c-d*) may be pivotally coupled to the corresponding push arms 116 proximal to the rod end 126, and the first auxiliary tilt hydraulic cylinder 122*f* may be coupled to the frame 102 proximal to the rod end 126. The first and second tilt hydraulic cylinders 122(*c-d*) may be configured to rotate the first implement 108 about the longitudinal axis AA and the transverse axis BB to provide a tilting movement to the first implement 108.

As shown in FIGS. 4-7 and 9, the machine 100 may also include a hydraulic system 140 for operating one or more of the hydraulic cylinders 122. The hydraulic system 140 includes a primary hydraulic circuit 142, a secondary hydraulic circuit 144, a flow sharing valve 146 and a load sense arrangement 148.

The primary hydraulic circuit 142 may include a first load sense controlled pump 150, a first supply passage 152, a first plurality 153 of implement valves 154, one or more primary circuit resolvers 156 and a primary circuit load sense passage 158.

The first load sense controlled pump 150 may be a variable displacement hydraulic pump operatively coupled to the power source 114 (FIG. 1) and configured to draw hydraulic fluid from a low-pressure reservoir 160, and provide hydraulic fluid flow to one or more of the plurality of hydraulic cylinders 122 (by way of each hydraulic cylinder's respective implement valve 154).

As such, the first load sense controlled pump 150 may include a stroke-adjusting mechanism (not shown), for example a swashplate or spill valve, a position of which is selectively adjusted based on a sensed circuit load to thereby vary an output of (i.e., a rate of fluid flow adequate to maintain a pressure at a margin above a (load) pressure signal) the first load sense controlled pump 150.

As the hydraulic cylinders 122 are extended or retracted, the implement(s) 108, 110 is/are moved. The weight of the actuated implement(s) 108, 110 and the load on such implement(s) 108, 110 create a load on the respective cylinders 122 and thereby create fluid pressures to counteract the resistances. In an embodiment, a return branch 162 of the primary circuit load sense passage 158 may direct the (load) pressure signal that is indicative of the fluid pressures from downstream of the first plurality 153 of implement valves 154 to the first load sense controlled pump 150. Based on a value of such pressure signal (i.e., based on a pressure of signal fluid within the return branch 162 of the primary circuit load sense passage 158), the pump control (in this embodiment, the controller 200) may change the position of the stroke-adjusting mechanism to either increase or decrease the output of first load sense controlled pump 150 such that the first load sense controlled pump 150 supplies adequate fluid flow to maintain a margin pressure or delta pressure above the load pressure signal of the actuated implement valve(s) 154 (there is no load pressure signal associated with implement valves 154 that are not actuated). For the purposes of this disclosure, a load sense controlled pump 150, 174 may be considered a pump that is hydro-mechanically controlled to vary a displacement based on a load of a hydraulic circuit, a pilot signal (pressure signal) indicative of the load being directed to a displacement mechanism of the pump.

The first supply passage 152 extends between the first load sense controlled pump 150 and the flow sharing valve 146.

Each of the first plurality 153 of implement valves 154 may be in selective fluid communication (either in an open position or a closed position) with the first load sense controlled pump 150 via the first supply passage 152. Each of the first plurality 153 of implement valves 154 may be in fluid communication with one or more of the hydraulic cylinders 122. In some embodiments discussed later herein, each of the first plurality 153 of implement valves 154 may, in some scenarios, also be in selective fluid communication with a second load sense controlled pump 174 via a second supply passage 176.

In an embodiment, the first plurality 153 of implement valves 154 may include a first lift valve 154*a* and a second lift valve 154*b*. In some embodiments, the first plurality 153 may also include additional implement valves 154. For example, as shown in FIGS. 4-7, the additional implement valves 154 may be an auxiliary lift valve 154*c* and an auxiliary tilt valve 154*d* for use in moving/operating the second implement 110 (the ripper) shown on the exemplary machine 100 of FIG. 1.

The first lift valve 154*a* is fluidly connected to both lift hydraulic cylinders 122*a* and 122*b* and the second lift valve 154*b* is fluidly connected to both lift hydraulic cylinders 122*a* and 122*b*. Lift valves 154*a* and 154*b* may be operated separately or together to supply flow to both lift hydraulic cylinders 122*a* and 122*b*. Lift hydraulic cylinders 122*a* and 122*b* are fluidly connected to each other to share the load of implement 108. The auxiliary lift valve 154*c* is fluidly connected to the auxiliary lift hydraulic cylinder 122*e* and the auxiliary tilt valve 154*d* is fluidly connected to the auxiliary tilt hydraulic cylinder 122*f*. Each of the auxiliary lift valve 154*c* and the auxiliary tilt valve 154*d* is configured to regulate the supply of hydraulic fluid to and from its respective hydraulic cylinder 122(*e-f*).

More specifically, each of the first and second lift valves 154*a*, 154*b*, the auxiliary lift valve 154*c* and the auxiliary tilt valve 154*d* is configured to selectively fluidly connect the cap end chamber 132 or the rod end chamber 134 of its corresponding hydraulic cylinder 122*a*, 122*b*, 122*e*, 122*f* to the source of pressurized fluid (first load sense controlled pump 150 and, in some scenarios the second load sense controlled pump 174, as discussed herein later) or to a fluid reservoir 160. As such, when the fluid source is fluidly connected to the cap end chamber 132, generally, the fluid reservoir 160 is fluidly connected to the rod end chamber 134. Conversely, when the fluid source is fluidly connected to the rod end chamber 134, generally, the fluid reservoir 160 is fluidly connected to the cap end chamber 132. The implement valves 154 may embody any suitable configurations such as, electrohydraulic valves known in the art.

Each of the plurality of primary circuit resolvers 156 is disposed downstream of at least one of the implement valves 154 (154*c*, 154*d*, 154*a*, 154*b*) (and its associated hydraulic cylinder 122) and upstream of the load sense arrangement 148. In the exemplary embodiment, the plurality of primary circuit resolvers 156 includes first, second and third primary circuit resolvers 156(*a-c*). Each primary circuit resolver 156 is in fluid communication with the primary circuit load sense passage 158 and at least one of the hydraulic cylinders 122. Each primary circuit resolver 156 may embody a two-position shuttle valve that is movable in response to a pressure signal between a first position 170, and a second position 172. Pressure of the respective hydraulic cylinder 122 is communicated through a passage of corresponding implement valve 154 to first position 170 only when that corresponding implement valve 154 is opened. Likewise, auxiliary lift valve 154*c* does not communicate pressure of the auxiliary lift hydraulic cylinder 122*e* to the primary circuit load sense passage 158 unless auxiliary lift valve 154*c* is opened. If no implement valves 154 are opened, no pressure signal is sent to the first load sense controlled pump 150. The shuttle valve of each primary circuit resolver 156 may be moved to the first position 170 when an upstream (load) pressure signal received from the primary circuit load sense passage 158 is greater than the (load) pressure signal at the respective implement valve 154 to which it is fluidly connected. The shuttle valve of each primary circuit resolver 156 may be moved to the second position 172 when the (load) pressure signal at the respective implement valve 154 (to which it is fluidly connected) is greater than the upstream (load) pressure signal received from the primary circuit load sense passage 158. Thus, each primary circuit resolver 156 is configured to allow to pass through the pressure signal received that has the highest comparative pressure.

In the exemplary hydraulic system of FIGS. 4-7, the first primary circuit resolver 156*a* is in fluid communication with the primary circuit load sense passage 158 at a point downstream of the auxiliary lift valve 154*c* (and its associated auxiliary lift cylinder 122*e*), and is in fluid communication with (and is downstream from) the auxiliary tilt valve 154*d* (and its associated auxiliary tilt cylinder 122*f*). The first primary circuit resolver 156*a* is configured to selectively allow the higher (load) pressure signal from either the primary circuit load sense passage 158 or the auxiliary tilt valve 154*d* to pass through (the first primary circuit resolver 156*a*) to the second primary circuit resolver 156*b*.

The second primary circuit resolver 156*b* is disposed downstream of the first primary circuit resolver 156*a* and the first lift valve 154*a* (and associated lift hydraulic cylinders 122*a* and 122*b*) and upstream of the third primary circuit resolver 156*c*. Similar to the first primary circuit resolver 156*a*, the second primary circuit resolver 156*b* is configured to selectively allow the higher (load) pressure signal from either the primary circuit load-sense passage 158 (between the first and second primary circuit resolvers 156*a*, 156*b*) or the first lift valve 154*a* to pass through (the second primary circuit resolver 156*b*) to the third primary circuit resolver 156*c*.

The third primary circuit resolver 156*c* is downstream of the second primary circuit resolver 156*b* and the second lift valve 154*b* (and associated lift hydraulic cylinders 122*a* and 122*b*) and upstream of the load sense arrangement 148. Similar to the first and second primary circuit resolvers 156(*a-b*), the third primary circuit resolver 156*c* is configured to selectively allow the higher (load) pressure signal from either the primary circuit load-sense passage 158 (between the second and third primary circuit resolvers 156(*b-c*)) or the second lift valve 154*b* to pass through (the third primary circuit resolver 156*c*) to the load sense arrangement 148.

As shown in FIGS. 4-7, a portion of the primary circuit load sense passage 158 fluidly connects the auxiliary lift valve 154*c* and the first primary circuit resolver 156*a*. Another portion of the primary circuit load sense passage 158 fluidly connects the first primary circuit resolver 156*a* and second primary circuit resolver 156*b*. Yet another portion of the primary circuit load sense passage 158 fluidly connects the second primary circuit resolver 156*b* to the third primary circuit resolver 156*c*. The output (load) pressure signal from the first primary circuit resolver 156*a* is input to the second primary circuit resolver 156*b*. The output (load) pressure signal from the second primary circuit resolver 156*b* is input to the third primary circuit resolver 156*c*. The output (load) pressure signal from the third primary circuit resolver 156*c* is input into the load sense arrangement 148 or more specifically the load sense valve 186 of the load sense arrangement 148. The output (load) pressure signal from the third primary circuit resolver 156*c* is also directed via the return branch 162 to the stroke-adjusting mechanism of the first load sense controlled pump 150. The return branch 162 connection is disposed upstream of the load sense valve 186 of the load sense arrangement 148.

The secondary hydraulic circuit 144 may include a second load sense controlled pump 174, a second supply passage 176, one or more implement valves 154 and a secondary circuit load sense passage 178. In some embodiments, the secondary hydraulic circuit 144 may also include a dual tilt valve 182.

Similar to the first load sense controlled pump 150, the second load sense controlled pump 174 may be a variable displacement hydraulic pump operatively coupled to the power source 114 (FIG. 1) and configured to draw hydraulic fluid from low-pressure fluid reservoir 160, and provide hydraulic fluid flow to the one or more of the plurality of hydraulic cylinders 122 (by way of such hydraulic cylinder's respective implement valve 154). As such, the second load sense controlled pump 174 may include a stroke-adjusting mechanism (not shown), for example a swashplate or spill valve, a position of which is selectively adjusted based on a sensed circuit load to thereby vary an output of (i.e., a rate of flow) the second load sense controlled pump 174. In an embodiment, a return branch 180 of the secondary circuit load sense passage 178 may direct a (load) pressure signal from downstream of the load sense arrangement 148 (more specifically, the main resolver 184) to the second load sense controlled pump 174. Based on a value of such pressure signal (i.e., based on a pressure of signal fluid within the secondary circuit load sense passage 178) the pump control (in this case, the controller 200) may change the position of the stroke-adjusting mechanism to either increase or decrease the output of second load sense controlled pump 174. As noted earlier, a load-sense controlled pump 150,174 may be considered a pump that is hydro-mechanically controlled to vary a displacement based on a load of a hydraulic circuit, a pilot signal (pressure signal) indicative of the load being directed to a displacement mechanism of the pump.

The second supply passage 176 extends between the second load sense controlled pump 174 and the flow sharing valve 146.

Each of the one or more implement valves 154 of the secondary hydraulic circuit 144 is in selective fluid communication (either in an open position or a closed position) with the second load sense controlled pump 174 via the second supply passage 176. Each of such implement valves 154 may be in fluid communication with one or more associated hydraulic cylinders 122.

In the exemplary embodiment shown in FIGS. 4-7 and 9, the secondary hydraulic circuit 144 may include an implement valve 154 that is a tilt valve 154*e*. In an embodiment, the tilt valve 154*e* may be in selective fluid connection with the dual tilt valve 182. In the embodiment shown, the dual tilt valve 182 is in selective fluid connection with each of the first and second tilt cylinders 122*c*, 122*d* and is configured to regulate a supply of hydraulic fluid to and from each of the first and second tilt cylinders 122*c*, 122*d*.

The exemplary dual tilt valve 182 has three commanded positions: single tilt, dual tilt and pitch. When in the single tilt position, hydraulic fluid flow is directed to one of the tilt hydraulic cylinders 122*c*/122*d*. When in the dual tilt position, hydraulic fluid is directed to both of the tilt hydraulic cylinders 122*d*,122*d* such that the tilt hydraulic cylinders 122*c*, 122*d* travel in opposite directions (as one tilt hydraulic cylinder extends, the other tilt hydraulic cylinder retracts.) In the pitch position, the dual tilt valve 182 directs flow from the rod end chamber 134 of the second tilt hydraulic cylinder 122*d* (left cylinder) to the cap end chamber 132 of the first tilt hydraulic cylinder 122*c* (right cylinder), and the hydraulic fluid from the rod end chamber 134 of the first tilt hydraulic cylinder 122*c* (right cylinder) is routed through the dual tilt valve 182 to tilt valve 154*e*. In the pitch position, as hydraulic fluid is fed to the cap end chamber 132 of the second tilt hydraulic cylinder 122*d* (left cylinder), that cylinder extends. As the hydraulic fluid from the rod end chamber 134 of the second tilt hydraulic cylinder 122*d* (left cylinder) is fed to the cap end chamber 124 of the first tilt hydraulic cylinder 122*c* (right cylinder), the right cylinder extends and hydraulic fluid in the rod end chamber 134 of the first tilt hydraulic cylinder 122*c* (right cylinder) is drained to the fluid reservoir 160. In this position/mode, both left and right cylinders extending results in blade 108*a* dump (pitch forward), for example a tilting movement of the first implement 108 about the transverse axis BB. Reversing the flow to supply hydraulic fluid to the rod end 126 of the right cylinder then causes the blade 108*a* to rack back (pitch reward).

When tilt valve 154*e* is opened, the secondary circuit load sense passage 178 fluidly connects the tilt valve 154*e* to the load sense arrangement 148. More specifically, the secondary circuit load sense passage 178 fluidly connects the tilt valve 154*e* to the main resolver 184 of the load sense arrangement 148. The output (load) pressure signal from the load sense arrangement 148 (more specifically the output pressure signal of the main resolver 184 of the load sense arrangement 148) is directed via return branch 180 to the stroke-adjusting mechanism of the second load sense controlled pump 174.

The flow sharing valve 146 is disposed between and selectively fluidly connects the primary and secondary hydraulic circuits 142, 144. More specifically, the flow sharing valve 146 is disposed between the first and second supply passages 152, 176. The flow sharing valve 146 is configured to allow flow from the secondary hydraulic circuit 144 to the primary hydraulic circuit 142 only if the fluid pressure in the second supply passage 176 is greater than the fluid pressure in the first supply passage 152. Conversely, the flow sharing valve 146 will not allow flow in the opposite direction regardless of the pressures in the first and second supply passages 152, 176.

The load sense arrangement 148 is configured to provide a (load) pressure signal to the stroke-adjusting mechanism of the second load sense controlled pump 174. In an embodiment, the load sense arrangement 148 may include a load sense valve 186 (selectively) fluidly connected to the main resolver 184.

The main resolver 184 is disposed downstream of the load sense valve 186 and upstream of the second load sense controlled pump 174. The main resolver 184 is in fluid communication with the load sense valve 186 via an intermediate load sense passage 188 that extends between the load sense valve 186 and the main resolver 184. The main resolver 184 is also in fluid communication with the second load sense controlled pump 174 via the return branch 180.

Like the primary circuit resolvers 156, the main resolver 184 may embody a two-position shuttle valve that is movable in response to a (load) pressure signal between a first position 170, and a second position 172. The shuttle valve of each main resolver 184 may be moved to the first position 170 when an upstream (load) pressure signal received from the intermediate load sense passage 188 is greater than the load pressure signal at the tilt valve 154*e*. The shuttle valve of each main resolver 184 may be moved to the second position 172 when the (tilt load) pressure signal at the tilt valve 154*e* is greater than the upstream (load) pressure signal received from the intermediate load sense passage 188. Thus, the main resolver 184 is configured to selectively allow to pass through the (load) pressure signal received from either the load sense valve 186 or the tilt valve 154*e* that has the highest comparative pressure. In other words, the main resolver 184 is configured to selectively allow the higher pressure signal received from either the intermediate load sense passage 188 or the secondary circuit load sense passage 178 to control the displacement of the second load sense controlled pump 174.

The load sense valve 186 is in fluid communication with the primary hydraulic circuit 142, and the third primary circuit resolver 156*c*, via the primary circuit load sense passage 158. The load sense valve 186 has an open position 190 at which hydraulic fluid flow between the primary hydraulic circuit 142 and the main resolver 184 is allowed, and a closed position 192 at which fluid flow between the primary hydraulic circuit 142 and the main resolver 184 is blocked. The load sense valve 186 may be a solenoid actuated valve. When the machine 100 is in the lift and dump operation of the first implement 108, 108*a*, the load sense valve 186 is in the closed position 192.

In one embodiment, the implement valves 154, the dual tilt valve 182 and their respective hydraulic cylinders 122 may be configured to be controlled based on a user input. Additionally or optionally, the implement valves 154, the dual tilt valve 182 and their respective hydraulic cylinders 122 may also be configured to be controlled automatically based on a type of the operation being performed, or a profile of the surface on which the operation is performed or other parameters.

The machine 100 may further include a controller 200 configured to open or close the implement valves 154, and the dual tilt valve 182. The controller 200 may be further configured to move the load sense valve 186 from an open position 190 to a closed position 192, or vice versa. In one embodiment, when the machine 100 is in the lift and dump operation for the first implement 108, 108*a*, the controller 200 may be configured to move the load sense valve 186 to the closed position 192.

The controller 200 may be an electronic controller that operates in a logical fashion to perform operations, execute control algorithms, store and retrieve data and other desired operations. The controller 200 may include or access memory, secondary storage devices, processors, and any other components for running an application. The memory and secondary storage devices may be in the form of read-only memory (ROM) or random access memory (RAM) or integrated circuitry that is accessible by the controller 200. Various other circuits may be associated with the controller 200 such as power supply circuitry, signal conditioning circuitry, driver circuitry, and other types of circuitry.

The controller 200 may be a single controller or may include more than one controller disposed to control various functions and/or features of the machine 100 and hydraulic system 140. The term "controller" is meant to be used in its broadest sense to include one or more controllers and/or microprocessors that may be associated with the machine 100 and that may cooperate in controlling various functions and operations of the machine 100, including functions and operations of the hydraulic system 140. The functionality of the controller 200 may be implemented in hardware and/or software without regard to the functionality employed. The controller 200 may also use one or more data maps relating to the operating conditions of the machine 100 that may be stored in the memory of the controller 200.

The controller 200 may be configured to determine an occurrence of the lift and dump operation for the first implement 108,108*a* based on any methods known in the art. In an example, the controller 200 may detect the lift and dump operation based on the commands from the operator provided via the input device in the cab 112. These commands may be transmitted via sensors and/or communication links to the controller 200. In another example, the controller 200 may detect the lift and dump operation based on a position of the first and second lift hydraulic cylinders 122*a*,122*b* and/or the first and second tilt hydraulic cylinders 122*c*, 122*d*. Moreover, these methods of determining or detecting the lift and dump cycle for the machine 100 are well known in the art and a detailed description is not included herein.

The controller 200 may be in operable communication with the implement valves 154, dual tilt valve 182, and the load sense valve 186. The controller 200 may be configured to open or close the implement valves 154, select any of the three positions of the dual tilt valve 182, and open (open position 190) or close (closed position 192) the load sense valve 186 according to the commanded work cycle/operation of the first and second implements 108, 110, including the lift and dump operation.

The controller 200 may also be in operable communication with lift and/or tilt cylinder sensors and may receive signals indicative of displacements of each of the lift and/or tilt hydraulic cylinders 122 via the corresponding lift and/or tilt cylinder sensors.

Also disclosed is a method of controlling the hydraulic system 140 of the machine 100. The method may comprise moving the load sense valve 186 to the closed position 192, and controlling, by only the secondary hydraulic circuit 144, the second load sense controlled pump 174 when the load sense valve 186 is in the closed position 192.

INDUSTRIAL APPLICABILITY

Figure 4:
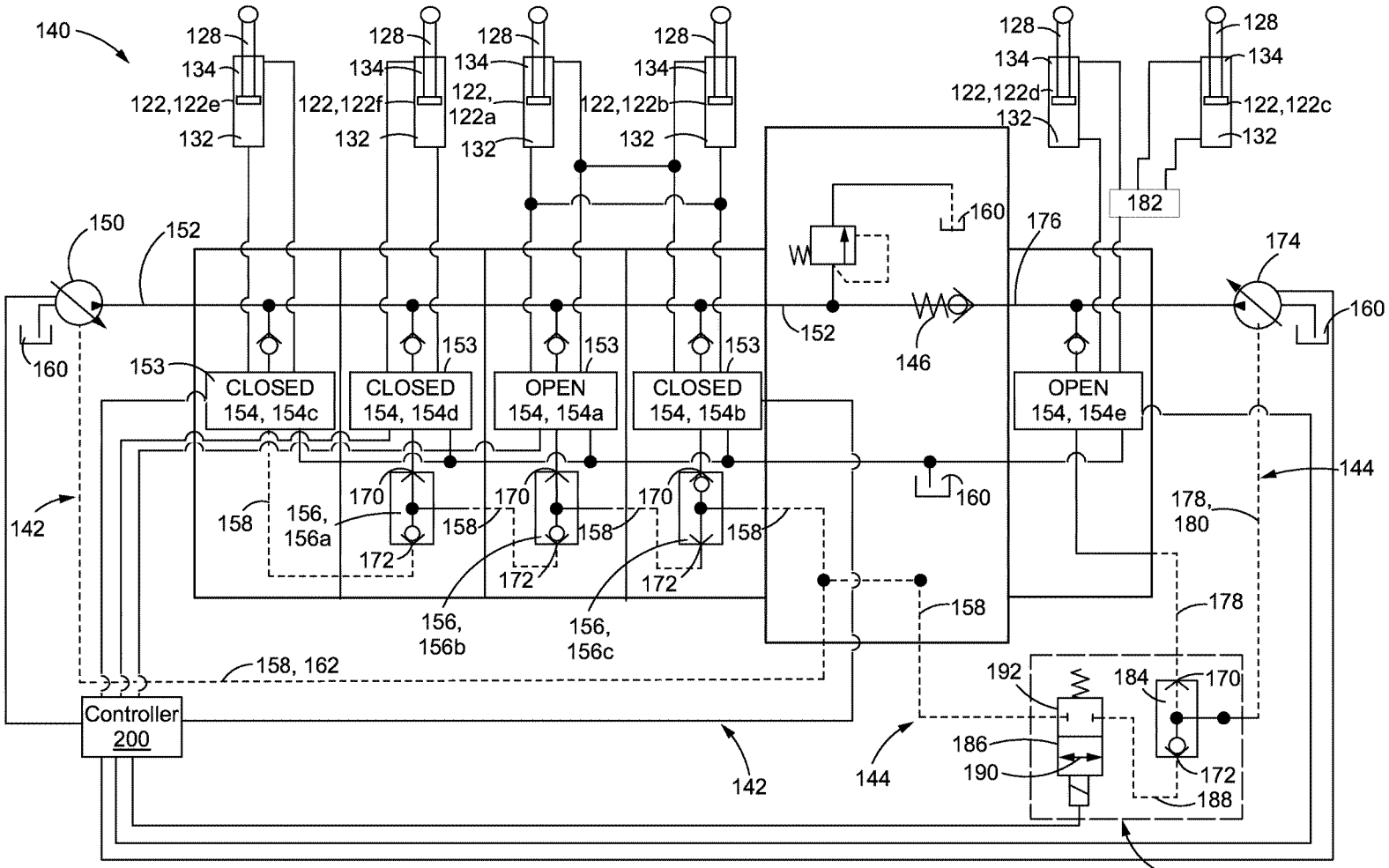
FIG. 4 is an embodiment of a schematic diagram of a hydraulic system used in the machine of FIG. 1.

FIG. 4 illustrates a schematic diagram of an exemplary hydraulic system 140 for the machine 100 of FIG. 1 when it is performing a lift and dump operation in which the (lift load) pressure signal at one of the first or second lift valves 164(*a-b*) (in this case, the first lift valve 154*a*) is greater than the (tilt load) pressure signal at the tilt valve 154*e*. During, or at the onset of, the lift and dump operation, the controller 200 may close (move to a closed position) all of the implement valves 154 except for the first lift valve 154*a* and the tilt valve 154*e*, and shift the dual tilt valve 182 to the pitch position. This blocks fluid flow from the first load sense controlled pump 150 through the second lift valve 154*b*, the auxiliary lift valve 154*c*, and the auxiliary tilt valve 154*d* to their associated hydraulic cylinders 122*a*, 122*b*,122*e*,122*f* (cylinders 122*a* and 122*b* may be configured such that each are connected to both first and second lift valves 154*a* and 154*b*). The controller 200 may open (move to an open position) the first lift valve 154*a* and the tilt valve 154*e*. Fluid from the first load sense controlled pump 150 flows through the first lift valve 154*a* to the first and second lift hydraulic cylinders 122*a* and 122*b*. During, or at the onset of, the lift and dump operation, the controller 200 moves the load sense valve 186 to a closed position 192 at which hydraulic fluid flow between the primary hydraulic circuit 142 and the main resolver 184 is blocked.

A pressure signal is directed to the second primary circuit resolver 156*b* from the first lift valve 154*a*. Since there is no pressure signal flowing to the first primary circuit resolver 156*a* from either the closed auxiliary lift valve 154*c* or the closed auxiliary tilt valve 154*d*, the pressure signal in the primary circuit load sense passage 158 immediately upstream of the second primary circuit resolver 156*b* is about zero. As such, the second primary circuit resolver 156*b* will pass through the (load) pressure signal received from the first lift valve 154*a* because that has the highest comparative pressure.

The third primary circuit resolver 156*c* receives the (load) pressure signal from the second primary circuit resolver 156*b*. No pressure signal is received from the closed second lift valve 154*b*. As such, the third primary circuit resolver 156*c* will pass through the (load) pressure signal received from the second primary circuit resolver 156*b* because that has the highest comparative pressure.

The first load sense controlled pump 150 receives via return branch 162 the (load) pressure signal output from the third primary circuit resolver 156*c*. Based on a value of the signal (i.e., based on the pressure of signal fluid within the return branch 162 of the primary circuit load sense passage 158) directed to stroke-adjusting mechanism, the position of stroke-adjusting mechanism may change to either increase or decrease the output of first load sense controlled pump 150. As a result, the first load sense controlled pump 150 is controlled only by (the load) of the primary hydraulic circuit 142.

The load sense valve 186 also receives via the primary circuit load sense passage 158 the (load) pressure signal output from the third primary circuit resolver 156*c*. Because the machine 100 is performing a lift and dump operation, the load sense valve 186 is in the closed position 192 at which pressure signal flow between the upstream primary hydraulic circuit 142 and the downstream main resolver 184 is blocked by the load sense valve 186. As such, the pressure signal in the intermediate load sense passage 188 immediately upstream of the main resolver 184 is relatively zero. The main resolver 184 will pass through the (load) pressure signal received from the open tilt valve 154*e* because that has the highest comparative pressure. Thus, the load pressure signal provided to the stroke-adjusting mechanism of the second load sense controlled pump 174 is the tilt load from the tilt valve 154*e*. Based on a value of the signal (i.e., based on the pressure of signal fluid within the return branch 180 of the secondary circuit load sense passage 178) directed to the stroke-adjusting mechanism, the position of stroke-adjusting mechanism may change to either increase or decrease the output of second load sense controlled pump 174. As a result, the second load sense controlled pump 174 is controlled only by the load of the secondary hydraulic circuit 144 and not by the load of the primary hydraulic circuit 142.

During normal operation with a blade 108*a* load it is expected that the second load sense controlled pump 174 will be working at a lower pressure than the output of the first load sense controlled pump 150, therefore the flow sharing valve 146 will remain closed and the flow from the first and second load sense controlled pumps 150, 174 to the implement valves 154 (and the dual tilt valve 182) will not be combined. As the second load sense controlled pump 174 is operating at a lower pressure it is also consuming less power than if it were operating at high pressure.

Figure 5:
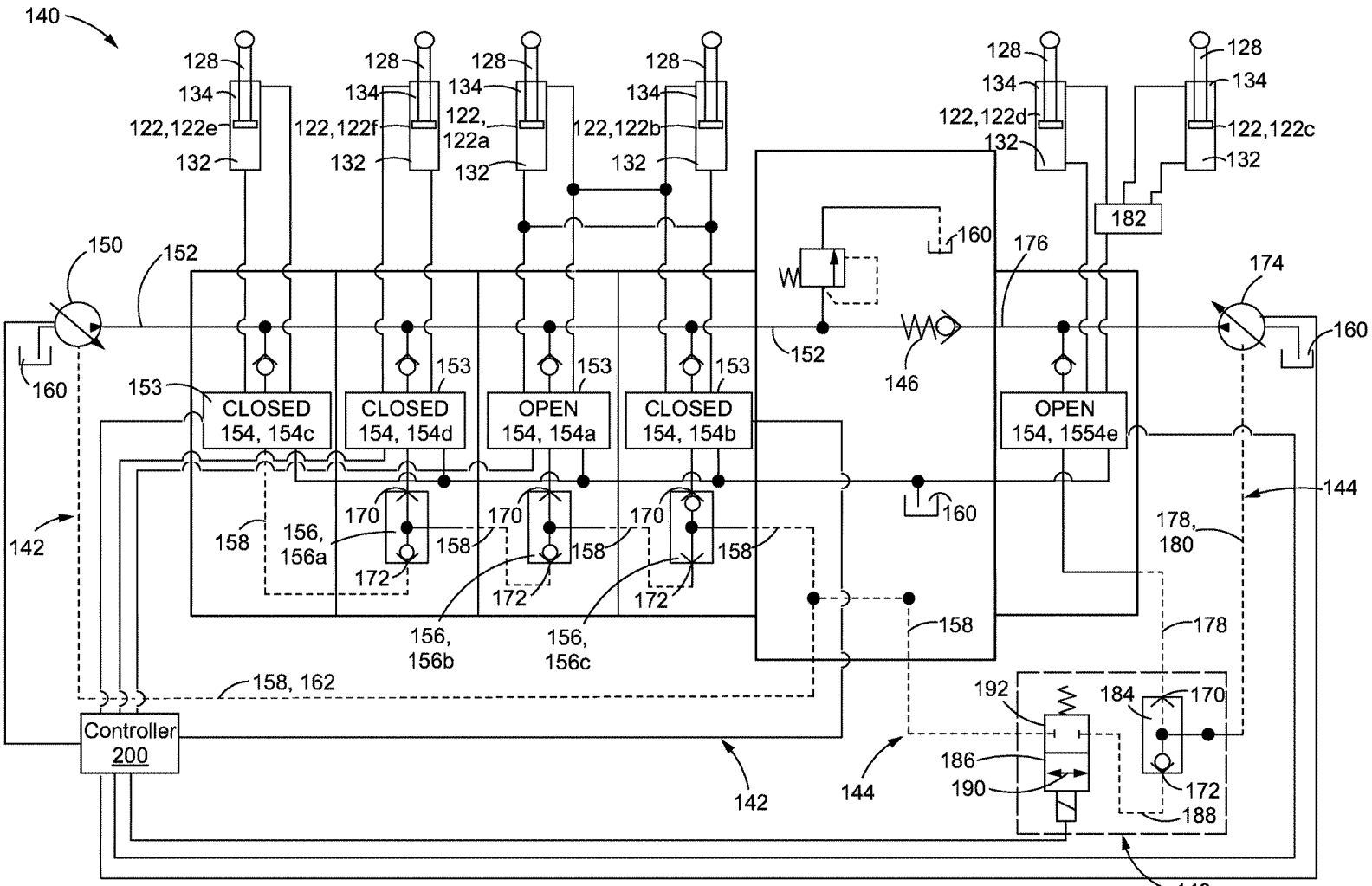
FIG. 5 is an embodiment of a schematic diagram of a hydraulic system used in the machine of FIG. 1.

FIG. 5 illustrates a schematic diagram of an exemplary hydraulic system 140 for the machine 100 of FIG. 1 during a lift and dump operation in which the tilt load pressure signal at the tilt valve 154*e* is greater than or becomes greater than the lift load pressure signal at one or both of first and second lift valves 154(*a*-*b*) (in this case at the first lift valve 154*a*). This may occur only when the machine 100 encounters an unusual load condition. During such a scenario, the load sense valve 186 is in the closed position 192.

Similar to the scenario of FIG. 4, all of the implement valves 154 are closed except for the first lift valve 154*a* and tilt valve 154*e*; this blocks fluid flow from the first load sense controlled pump 150 through the second lift valve 154*b*, the auxiliary lift valve 154*c*, and the auxiliary tilt valve 154*d* to their associated hydraulic cylinders 122*a*, 122*b*,122*e*,122*f*. The first lift valve 154*a* and tilt valve 154*e* are in an open position. Fluid from the first load sense controlled pump 150 flows through the first lift valve 154*a* to the first and second lift hydraulic cylinders 122*a* and 122*b*. The load sense valve 186 is in a closed position 192 at which hydraulic fluid flow between the primary hydraulic circuit 142 and the main resolver 184 is blocked.

A pressure signal is directed to the second primary circuit resolver 156*b* from the first lift valve 154*a*. Since there is no pressure signal flowing to the first primary circuit resolver 156*a* from either the closed auxiliary lift valve 154*c* or the closed auxiliary tilt valve 154*d*, the (load) pressure signal in the primary circuit load sense passage 158 immediately upstream of the second primary circuit resolver 156*b* is about zero. As such, the second primary circuit resolver 156*b* will pass through the (load) pressure signal received from the first lift valve 154*a* because that has the highest comparative pressure.

The third primary circuit resolver 156*c* receives the (load) pressure signal from the second primary circuit resolver 156*b*. No (load) pressure signal is received from the closed second lift valve 154*b*. As such, the third primary circuit resolver 156*c* will pass through the (load) pressure signal received from the second primary circuit resolver 156*b* because that has the highest comparative pressure.

The first load sense controlled pump 150 receives via return branch 162 the (load) pressure signal output from the third primary circuit resolver 156*c*. Based on a value of the signal (i.e., based on the pressure of signal fluid within the return branch 162 of the primary circuit load sense passage 158) directed to stroke-adjusting mechanism, the position of stroke-adjusting mechanism may change to either increase or decrease the output of first load sense controlled pump 150. As a result, the first load sense controlled pump 150 is controlled only by the load of the primary hydraulic circuit 142 and not by the load of the secondary hydraulic circuit 144.

The load sense valve 186 also receives via the primary circuit load sense passage 158 the signal (fluid) output from the third primary circuit resolver 156*c*. Because the machine 100 is performing a lift and dump operation, the load sense valve 186 is in the closed position 192 at which (load) pressure signal flow between the upstream primary hydraulic circuit 142 and the downstream main resolver 184 is blocked. As such, the (load) pressure signal in the intermediate load sense passage 188 immediately upstream of the main resolver 184 is relatively zero.

The main resolver 184 will pass through the (load) pressure signal received from the tilt valve 154*e* because that has the highest comparative pressure. Thus, the (load) pressure signal provided to the stroke-adjusting mechanism of the second load sense controlled pump 174 is the tilt load pressure signal from tilt valve 154*e*. Based on a value of the signal (i.e., based on the pressure of signal fluid within the return branch 180 of the secondary circuit load sense passage 178) directed to stroke-adjusting mechanism, the position of stroke-adjusting mechanism may change to either increase or decrease the output of second load sense controlled pump 174. As a result, the second load sense controlled pump 174 is controlled only by the load of the secondary hydraulic circuit 144. However, since the output of the second load sense controlled pump 174 is at a higher pressure than the output of the first load sense controlled pump 150, the flow sharing valve 146 will open and the flow from the first and second load sense controlled pumps 150, 174 to the open first lift valve 154*a* will be combined. The hydraulic fluid will follow the path of least resistance and the lift load requirements will be meet before the tilt load requirements.

If the (load) pressure signal from implement valve 154*e* is higher than that of the return branch 162, the first load sense controlled pump 150 will receive the lower (load) pressure signal from the return branch 162. The second load sense controlled pump 174 will receive the higher (load) pressure signal from 154*e*. The flow sharing valve 146 then shares flow to the primary hydraulic circuit 142 as pressure dictates. If the pressure in passage 152 increases adequately above the signal pressure in passage 162, then the first load sense controlled pump 150 destrokes as it is responding to a lower (load) pressure signal. When the first load sense controlled pump 150 senses a higher discharge pressure from the second load sense controlled pump 174, the first load sense controlled pump 150 may be configured to operate as if the flow demands with regard to the lower pressure signal have been met. This results in only the second load sense controlled pump 174 supplying flow to both the primary hydraulic circuit 142 and the secondary hydraulic circuit 144.

Figure 6:
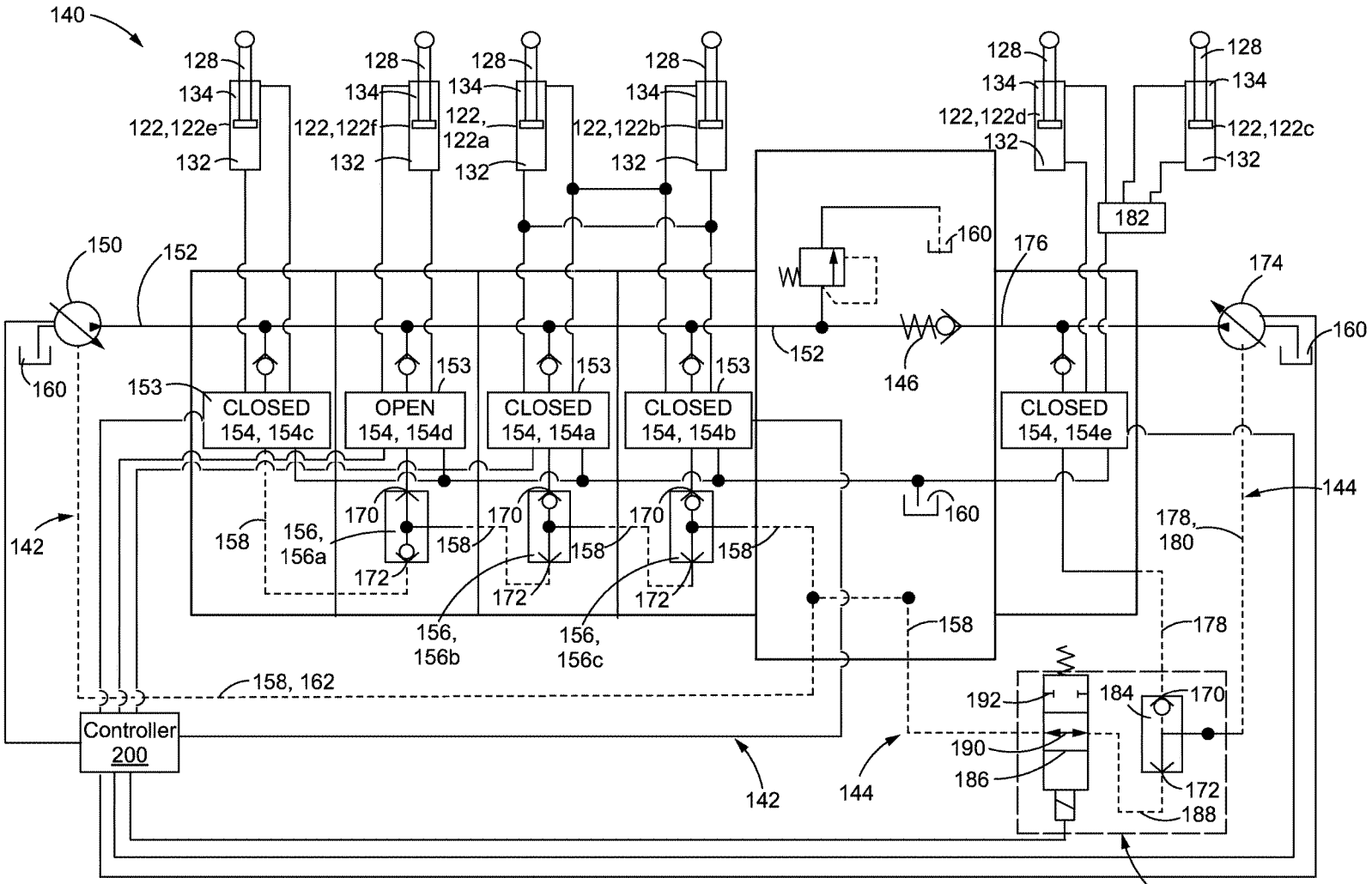
FIG. 6 is an embodiment of a schematic diagram of a hydraulic system used in the machine of FIG. 1.

FIG. 6 illustrates a schematic diagram of an exemplary hydraulic system 140 for the machine 100 of FIG. 1 when it is performing an operation of the second implement 110 that requires use of the auxiliary tilt cylinder 122*f* (in an operation other than a lift and dump operation) in which the auxiliary tilt load pressure signal of the second implement 110 (in the primary hydraulic circuit 142) is the only implement load pressure signal. For this operation, the controller 200 may close (move to a closed position) all of the implement valves 154 except for the auxiliary tilt valve 154*d*. This blocks fluid flow from the first load sense controlled pump 150 through the first and second lift valves 154*a*, 154*b*, and the auxiliary lift valve 154*c* to their associated hydraulic cylinders 122*a*, 122*b*,122*e*. The controller 200 may open (move to an open position) the auxiliary tilt valve 154*d* and may close the tilt valve 154*e*. Fluid from the first load sense controlled pump 150 flows through the auxiliary tilt valve 154*d* to the auxiliary tilt hydraulic cylinder 122*f*. The controller 200 also moves the load sense valve 186 to an open position 190 at which hydraulic fluid flow between the primary hydraulic circuit 142 and the main resolver 184 is allowed.

A pressure signal flows to the first primary circuit resolver 156*a* from the open auxiliary tilt valve 154*d*. No pressure signal flows from the closed auxiliary lift valve 154*c* to the first primary circuit resolver 156*a*. As such, the first primary circuit resolver 156*a* will pass through the (load) pressure signal received from the auxiliary tilt valve 154*d* because that has the highest comparative pressure.

The second primary circuit resolver 156*b* receives the (load) pressure signal output from the first primary circuit resolver 156*a*. No pressure signal flows from the closed first lift valve 154*a* to the second primary circuit resolver 156*b*. As such, the second primary circuit resolver 156*b* will pass through the (load) pressure signal received from the first primary circuit resolver 156*a* (which is that of the auxiliary tilt valve 154*d*) because that has the highest comparative pressure.

The third primary circuit resolver 156*c* receives the (load) pressure signal from the second primary circuit resolver 156*b*. No pressure signal is received from the closed second lift valve 154*b*. As such, the third primary circuit resolver 156*c* will pass through the (load) pressure signal received from the second primary circuit resolver 156*b* (which is that of the auxiliary tilt valve 154*d*) because that has the highest comparative pressure.

The first load sense controlled pump 150 receives via return branch 162 the (load) pressure signal output from the third primary circuit resolver 156*c*. Based on a value of the pressure signal (i.e., based on the pressure of signal fluid within the return branch 162 of the primary circuit load sense passage 158) directed to stroke-adjusting mechanism, the position of stroke-adjusting mechanism may change to either increase or decrease the output of first load sense controlled pump 150. As a result, the first load sense controlled pump 150 is controlled only by the load pressure of the primary hydraulic circuit 142.

The load sense valve 186 also receives via the primary circuit load sense passage 158 the (load) pressure signal output from the third primary circuit resolver 156*c*. The load sense valve 186 is in the open position 190 at which signal fluid flow between the upstream primary hydraulic circuit 142 and the downstream main resolver 184 is allowed. As such, the (load) pressure signal in the intermediate load sense passage 188 immediately upstream of the main resolver 184 is that of the primary hydraulic circuit 142 (more specifically, that of the auxiliary tilt valve 154*d*.)

Since the tilt valve 154*e* is closed, the (load) pressure signal received by the main resolver 184 from the secondary circuit load sense passage 178 is about zero. As such, the main resolver 184 will pass through the (load) pressure signal received from the load sense valve 186 (via the intermediate load sense passage 188) because that has the highest comparative pressure. Thus, the (load) pressure signal provided to the stroke-adjusting mechanism of the second load sense controlled pump 174 is that from the primary hydraulic circuit 142 (more specifically, in this case, the tilt load pressure signal of the auxiliary tilt valve 154*d*). Based on a value of the pressure signal (i.e., based on the pressure of signal fluid within the return branch 180 of the secondary circuit load sense passage 178) directed to stroke-adjusting mechanism, the position of stroke-adjusting mechanism may change to either increase or decrease the output of second load sense controlled pump 174. As a result, in this scenario, the second load sense controlled pump 174 is controlled by the load of the primary hydraulic circuit 142 and not the load of the secondary hydraulic circuit 144.

In the absence of any other adjustments, the output of the first and second load sense controlled pumps 150, 174 would be about the same. However, when the sensed load pressure signal in the return branch 180 of the secondary circuit load sense passage 178 is about the same as the output pressure of the first load sense controlled pump 150, the controller 200 may, in some embodiments, be configured to increase the output pressure of the second load sense controlled pump 174 above that of the sensed load pressure signal in the return branch 180 (in some embodiments, the controller 200 may include a load sense controller or microcontroller disposed on the second load sense controlled pump 174 for control of such functionality). Thus, the output pressure of the second load sense controlled pump 174 may be higher than the output pressure of the first load sense controlled pump 150 and the flow sharing valve 146 will open and the flow from the first and second load sense controlled pumps 150, 174 to the auxiliary tilt valve 154*d* will be combined.

Figure 7:
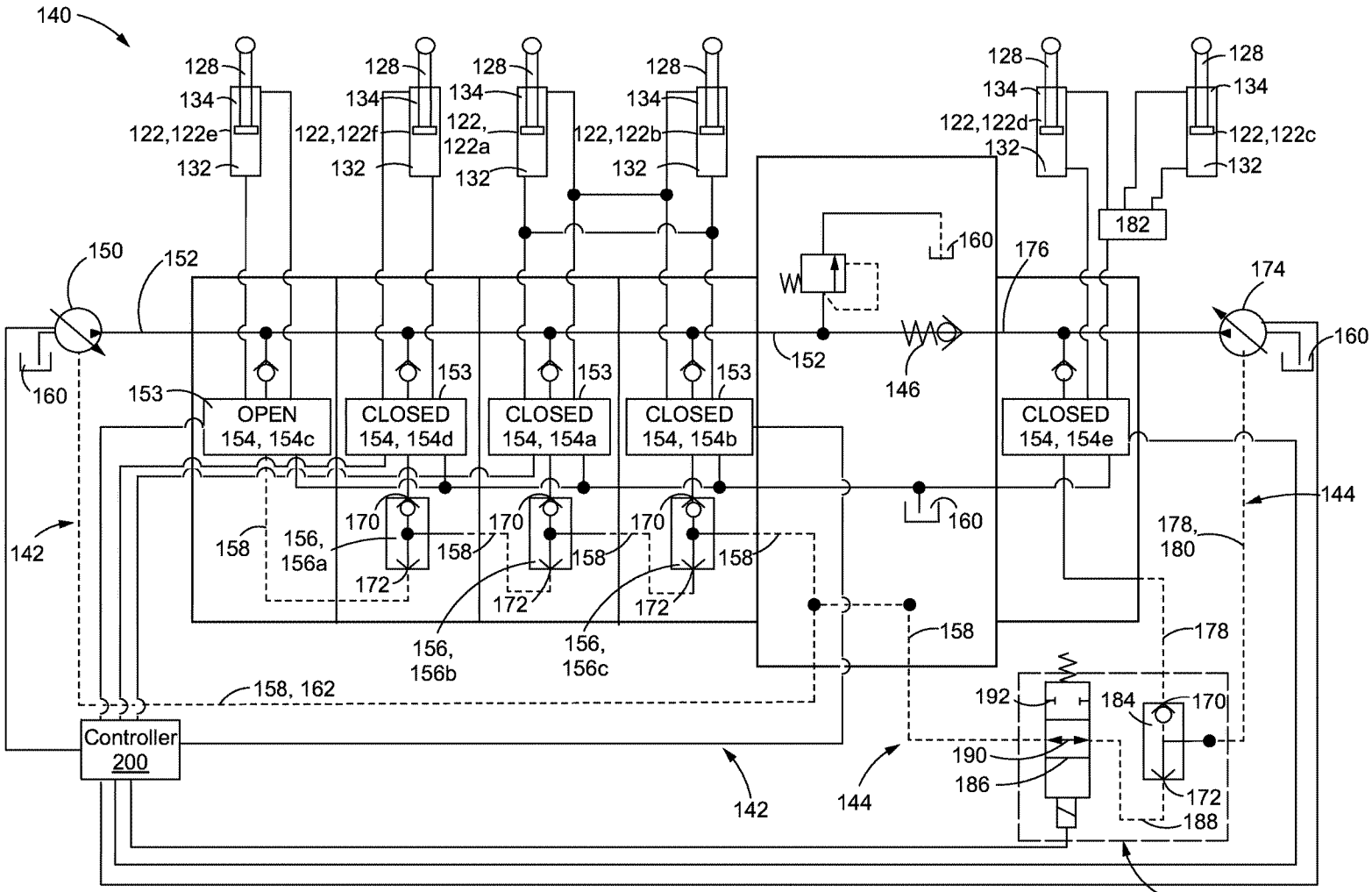
FIG. 7 is an embodiment of a schematic diagram of a hydraulic system used in the machine of FIG. 1.

FIG. 7 illustrates a schematic diagram of an exemplary hydraulic system 140 for the machine 100 of FIG. 1 when it is performing an operation of the second implement 110 that requiring use of the auxiliary lift cylinder 122*e* (in an operation other than a lift and dump operation) in which the auxiliary lift load pressure signal of the second implement 110 (in the primary hydraulic circuit 142) is the only implement load signal. For this operation, the controller 200 may close (move to a closed position) all of the implement valves 154 except for the auxiliary lift valve 154*c*. This blocks fluid flow from the first load sense controlled pump 150 through the first and second lift valves 154*a*, 154*b*, and the auxiliary tilt valve 154*d* to their associated hydraulic cylinders 122*a*, 122*b*,122*f*. The controller 200 may open (move to an open position) the auxiliary lift valve 154*c*. Fluid from the first load sense controlled pump 150 flows through the auxiliary lift valve 154*c* to the auxiliary lift hydraulic cylinder 122*e*. The controller 200 also moves the load sense valve 186 to an open position 190 at which hydraulic fluid flow between the primary hydraulic circuit 142 and the main resolver 184 is allowed.

A pressure signal is directed to the first primary circuit resolver 156*a* from the open auxiliary lift valve 154*c*. No (load) pressure signal flows from the closed auxiliary tilt valve 154*d* to the first primary circuit resolver 156*a*. As such, the first primary circuit resolver 156*a* will pass through the (load) pressure signal received from the auxiliary lift valve 154*c* because that has the highest comparative pressure.

The second primary circuit resolver 156*b* receives the (load) pressure signal output from the first primary circuit resolver 156*a*. No (load) pressure signal flows from the closed first lift valve 154*a* to the second primary circuit resolver 156*b*. As such, the second primary circuit resolver 156*b* will pass through the (load) pressure signal received from the first primary circuit resolver 156*a* (which is that of the auxiliary lift valve 154*c*) because that has the highest comparative pressure.

The third primary circuit resolver 156*c* receives (load) pressure signal from the second primary circuit resolver 156*b*. No (load) pressure signal is received from the closed second lift valve 154*b*. As such, the third primary circuit resolver 156*c* will pass through the (load) pressure signal received from the second primary circuit resolver 156*b* (which is that of the auxiliary lift valve 154*c*) because that has the highest comparative pressure.

The first load sense controlled pump 150 receives via return branch 162 the (load) pressure signal output from the third primary circuit resolver 156*c*. Based on a value of the pressure signal (i.e., based on the pressure of signal fluid within the return branch 162 of the primary circuit load sense passage 158) directed to stroke-adjusting mechanism, the position of stroke-adjusting mechanism may change to either increase or decrease the output pressure of the first load sense controlled pump 150. As a result, the first load sense controlled pump 150 is controlled only by the load pressure of the primary hydraulic circuit 142.

The load sense valve 186 also receives via the primary circuit load sense passage 158 the (load) pressure signal output from the third primary circuit resolver 156*c*. The load sense valve 186 is in the open position 190 at which (load) pressure signal flow between the upstream primary hydraulic circuit 142 and the downstream main resolver 184 is allowed. As such, the (load) pressure signal in the intermediate load sense passage 188 immediately upstream of the main resolver 184 is that of the primary hydraulic circuit 142 (more specifically, the tilt load pressure signal at the auxiliary lift valve 154*c*.)

Since the tilt valve 154*e* is closed, the (load) pressure signal received by the main resolver 184 from the secondary circuit load sense passage 178 is about zero. As such, the main resolver 184 will pass through the (load) pressure signal received from the load sense valve 186 (via the intermediate load sense passage 188) because that has the highest comparative pressure. Thus, the (load) pressure signal provided to the stroke-adjusting mechanism of the second load sense controlled pump 174 is the load of the primary hydraulic circuit 142 (more specifically, in this case, the lift load pressure signal of the auxiliary lift valve 154*c*). Based on a value of the pressure signal (i.e., based on the pressure of signal fluid within the return branch 180 of the secondary circuit load sense passage 178) directed to stroke-adjusting mechanism, the position of stroke-adjusting mechanism may change to either increase or decrease the output of second load sense controlled pump 174. Thus, the second load sense controlled pump 174 is controlled only by the load of the primary hydraulic circuit 142.

Similar to the scenario of FIG. 6, in the absence of any other adjustments, the output of the first and second load sense controlled pumps 150, 174 would be about the same. However, when the sensed load pressure signal in the return branch 180 of the secondary circuit load sense passage 178 is about the same as the output pressure of the first load sense controlled pump 150, the controller 200 may, in some embodiments, be configured to increase the output pressure of the second load sense controlled pump 174 above that of the sensed load pressure signal in the return branch 180 (in some embodiments, the controller 200 may include a load sense controller or microcontroller disposed on the second load sense controlled pump 174 for control of such functionality). In such a case, the output pressure of the second load sense controlled pump 174 may be higher than the output pressure of the first load sense controlled pump 150 and the flow sharing valve 146 will open and the flow from the first and second load sense controlled pumps 150, 174 to the auxiliary lift valve 154*c* will be combined.

Figure 9:
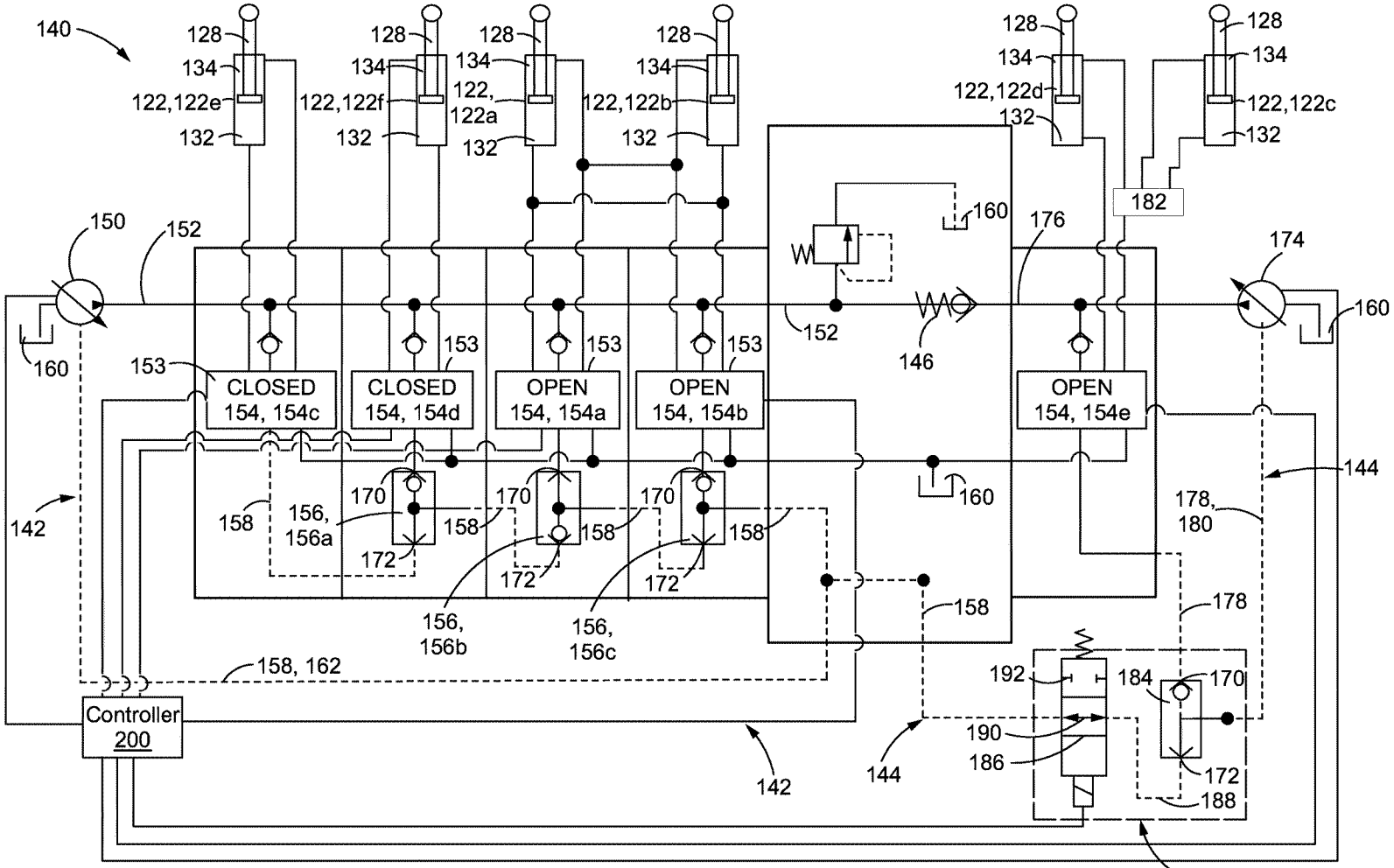
FIG. 9 is an embodiment of a schematic diagram of a hydraulic system used in the machine of FIG. 1.

FIG. 9 illustrates a schematic diagram of an exemplary hydraulic system 140 for the machine 100 of FIG. 1 during an operation in which the lift load pressure signal at one or both of the first and second lift valves 154(*a*-*b*) (in this case both) is greater than the tilt load pressure signal at the tilt valve 154*e*. This may occur when the first and second lift valves 154*a*, 154*b* and tilt valve 154*e* are activated at the same time while dual tilt valve 182 is in either the single tilt or dual tilt modes (not pitch mode). Under this situation, the load sense valve 186 is in an open position 190 at which hydraulic fluid flow between the primary hydraulic circuit 142 and the main resolver 184 is allowed.

In this scenario, all of the implement valves 154 are closed except for the first and second lift valves 154*a*, 154*b* and the tilt valve 154*e*; this blocks fluid flow from the first load sense controlled pump 150 through the auxiliary lift valve 154*c* and the auxiliary tilt valve 154*d* to their associated hydraulic cylinders 122*e*,122*f*. The first and second lift valves 154*a*, 154*b* and the tilt valve 154*e* are in an open position and fluid from the first load sense controlled pump 150 flows through the first and second lift valves 154*a*, 154*b* to the first and second lift hydraulic cylinders 122*a*, 122*b*.

Under this situation, the main resolver 184 will be in the first position 170 because the pressure signal at the tilt valve 154*e* is less than that received via the load sense valve 186 (and primary circuit resolvers 156) from the first or second lift valves 154*a*, 154*b*. Thus, both the first and second load sense controlled pumps 150, 174 will receive (via the respective return branches 162,180) the higher (load) pressure signal from the first lift valve 154*a* or the second lift valve 154*b*. As a result, the second load sense controlled pump 174 will supply fluid flow to the tilt valve 154*e* at a higher pressure than required. The tilt valve 154*e* will then flow fluid to the dual tilt valve 182 and the second tilt cylinder 122*d* and the first tilt cylinder 122*c*, if in dual tilt mode (only the second tilt cylinder 122*d* if in single tilt mode). Excess flow from the second load sense controlled pump 174 not used by the tilt valve 154*e* will be shared across the flow sharing valve 146 to the primary hydraulic circuit 142.

Figure 8:
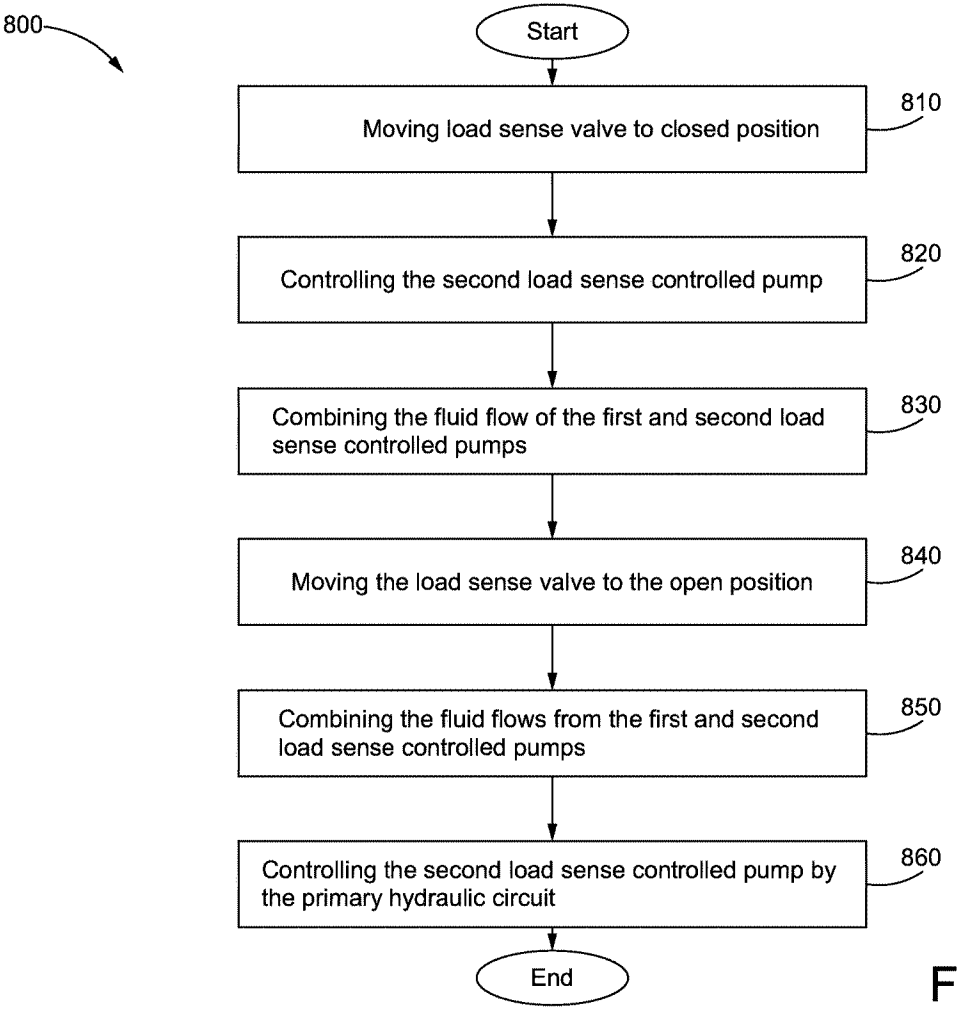
FIG. 8 is a flowchart of an exemplary method of controlling a hydraulic system on a machine, according to an embodiment of the current disclosure.

Referring to FIG. 8, a method 800 of controlling a hydraulic system 140 of the machine 100 is illustrated. The method 800 will be explained in conjunction with the machine 100 of FIG. 1.

In block 810, the method 800 includes moving, by the controller 200, the load sense valve 186 to the closed position 192. In an embodiment, this may occur when the machine 100 is in a lift and dump operation of the first implement 108.

In block 820, the method 800 includes controlling, by only the secondary hydraulic circuit 144, the second load sense controlled pump 174 when the load sense valve 186 is in the closed position 192. In an embodiment, this may occur when the lift load pressure signal at either the first or second lift valves 154*a*, 154*b* of the primary hydraulic circuit 142 is greater than the tilt load pressure signal at the implement valve 154 (dual tilt valve 182) of the secondary hydraulic circuit 144. Alternatively, this may occur when the tilt load pressure signal at the implement valve 154 (dual tilt valve 182) of the secondary hydraulic circuit 144 is greater than the lift load pressure signal at either the first or second lift valves 154*a*, 154*b* of the primary hydraulic circuit 142.

In block 830, the method may further include combining the fluid flow of the first and second load sense controlled pumps 150, 174.

In block 840, the method may include moving, by the controller 200, the load sense valve 186 to the open position 190.

In block 850, the method may further comprise combining hydraulic fluid flows from the first and second load sense controlled pumps 150, 174 when the load sense valve 186 is in the open position 190. In an embodiment, this may occur when the load pressure of the primary hydraulic circuit 142 is greater than that of the secondary hydraulic circuit 144.

In block 860, the method may further comprise substantially controlling, by the primary hydraulic circuit 142, the second load sense controlled pump 174.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A hydraulic system on a machine, the machine including a first implement, the hydraulic system comprising:

a primary hydraulic circuit that includes a first load sense controlled pump;

a secondary hydraulic circuit that includes a second load sense controlled pump;

a flow sharing valve disposed between the primary and secondary hydraulic circuits; and a load sense arrangement for the second load sense controlled pump, the load sense arrangement including:

a main resolver disposed between a control valve for a load on the secondary hydraulic circuit, a load sense valve, and the second load sense controlled pump and having a two-position shuttle valve movable between a first position fluidly connecting the control valve to the second load sense controlled pump and disconnecting the second load sense controlled pump from the load sense valve and a second position fluidly connecting the load sense valve to the second load sense controlled pump, wherein:

the two-position shuttle valve is in the first position when a pressure signal received from the control valve is higher than a pressure signal received from the load sense valve; and the two-position shuttle valve is in the second position when a pressure signal received from the load sense valve is higher than a pressure signal received from the control valve; and the load sense valve having an open position at which pressure signal flow between the primary hydraulic circuit and the main resolver is allowed, and a closed position at which pressure signal flow between the primary hydraulic circuit and the main resolver is blocked, wherein when the load sense valve is in the closed position, the second load sense controlled pump is controlled only by the secondary hydraulic circuit.

2. The hydraulic system of claim 1, wherein the load sense valve is in the closed position when the machine is in a lift and dump operation of the first implement.

3. The hydraulic system of claim 1, wherein when the load sense valve is in the open position, fluid flows from the first and second load sense controlled pumps are combined when a primary circuit load pressure signal is lower than a secondary circuit load pressure signal.

4. The hydraulic system of claim 1, wherein when the load sense valve is solenoid actuated to either the open position or the closed position.

5. A method of controlling a hydraulic system of a machine, the machine including a first implement, the hydraulic system comprising a primary hydraulic circuit, a secondary hydraulic circuit, a flow sharing valve and a load sense arrangement, the primary hydraulic circuit including a first load sense controlled pump, the secondary hydraulic circuit including a second load sense controlled pump, the load sense arrangement including a main resolver disposed between a control valve for a load on the secondary hydraulic circuit, a load sense valve, and the second load sense controlled pump, the main resolver having a two-position shuttle valve movable between a first position and a second position and the load sense valve having an open position at which pressure signal flow between the primary hydraulic circuit and the main resolver is allowed, and a closed position at which pressure signal flow between the primary hydraulic circuit and the main resolver is blocked, the method comprising:

operating the two-position shuttle valve in the first position when a pressure signal received from the control valve is higher than a pressure signal received from the load sense valve, wherein in the first position, the main resolver fluidly connects the control valve to the second load sense controlled pump and disconnects the second load sense controlled pump from the load sense valve;

operating the two-position shuttle valve in the second position when a pressure signal received from the load sense valve is higher than a pressure signal received from the control valve, wherein in the second position, the main resolver fluidly connects the load sense valve to the second load sense controlled pump;

moving the load sense valve to the closed position; and controlling, by only the secondary hydraulic circuit, the second load sense controlled pump when the load sense valve is in the closed position.

6. The method of claim 5, wherein the load sense valve is moved to the closed position when the machine is in a lift and dump operation of the first implement.

7. The method of claim 5, wherein the first implement is a blade.

8. A hydraulic system on a machine, the machine including a first implement and a second implement, the machine operable in a work cycle that includes a lift and dump operation of the first implement, the hydraulic system comprising:

a primary hydraulic circuit that includes a first load sense controlled pump, first and second lift hydraulic cylinders operably connected to the first implement;

a secondary hydraulic circuit that includes a second load sense controlled pump and first and second tilt hydraulic cylinders operably connected to the first implement;

a flow sharing valve disposed between the primary and secondary hydraulic circuits; and a load sense arrangement for the second load sense controlled pump, the load sense arrangement including:

a main resolver disposed between a control valve for a load on the secondary hydraulic circuit, a load sense valve, and the second load sense controlled pump and having a two-position shuttle valve movable between a first position fluidly connecting the control valve to the second load sense controlled pump and disconnecting the second load sense controlled pump from the load sense valve and a second position fluidly connecting the load sense valve to the second load sense controlled pump, wherein:

the two-position shuttle valve is in the first position when a pressure signal received from the control valve is higher than a pressure signal received from the load sense valve; and the two-position shuttle valve is in the second position when a pressure signal received from the load sense valve is higher than a pressure signal received from the control valve;

the load sense valve having an open position at which pressure signal flow between the primary hydraulic circuit and the main resolver is allowed, and a closed position at which pressure signal flow between the primary hydraulic circuit and the main resolver is blocked, wherein when the machine is in the lift and dump operation of the first implement, the load sense valve is in the closed position and the second load sense controlled pump is controlled only by the secondary hydraulic circuit.

9. The hydraulic system of claim 8, wherein the load sense valve is a solenoid actuated to either the open position or the closed position.

10. The hydraulic system of claim 8, wherein the first implement is a blade.

11. The hydraulic system of claim 8, wherein when the machine is not in the lift and dump operation of the first implement, the load sense valve is in the open position.

12. The hydraulic system of claim 8, in which the primary hydraulic circuit further includes a plurality of lift valves in fluid communication with the first and second lift hydraulic cylinders and the first load sense controlled pump, and the secondary hydraulic circuit includes a tilt valve in fluid communication with the first and second tilt hydraulic cylinders and the second load sense controlled pump.

* * * * *